US005293858A

United States Patent [19]

Peters

[11] Patent Number: 5,293,858

[45] Date of Patent: Mar. 15, 1994

[54] APPARATUS AND METHOD FOR CONE SHAPING THE CROWN AND PAVILION OF GEMSTONES

[76] Inventor: Nizam U. Peters, 5718 NE. 17th Ave., Ft. Lauderdale, Fla. 33334

[21] Appl. No.: 860,036

[22] Filed: Mar. 30, 1992

[51] Int. Cl.[5] ..... B28D 5/00

[52] U.S. Cl. ..... 125/30.01; 51/283 R; B28D/5/00

[58] Field of Search ..... 125/30.01; 51/283 R, 51/283 E

[56] References Cited

U.S. PATENT DOCUMENTS

| | | | |
|---|---|---|---|
| 172,589 | 1/1876 | Stover | 125/30.01 |
| 1,105,356 | 7/1914 | Ludlow et al. | 125/30.01 |
| 2,332,574 | 10/1943 | Hopp | 125/30.01 X |
| 3,202,147 | 8/1965 | Roos | 125/30.01 |
| 3,568,368 | 3/1971 | Gwircman | 125/30.01 X |
| 4,425,900 | 1/1984 | Bosschaert | 125/30.01 |

*Primary Examiner*—Bruce M. Kisliuk
*Assistant Examiner*—Bryan Reichenbach
*Attorney, Agent, or Firm*—Malin, Haley, DiMaggio & Crosby

[57] ABSTRACT

Apparatus and methods for simultaneously cone cutting of crown portions and pavilions of gemstones are provided by the present invention. Each of the gemstones to be simultaneously cut are individually mounted in a motor rotating collet which is mounted on a base plate. One of the base plates is provided with additional motor-driven apparatus to move the plate at an angle of approximately 45° to the axial center line of the gemstone. The second gemstone is rotated by a motor attached to the collet by a support plate. The support plate moves in a direction toward the first gemstone at an angle approximately 45° to the axial center line of the second gemstone and, such that, it is perpendicular to the back and forth motion provided by the motor apparatus of the first gemstone. In this manner, each of the gemstones are simultaneously coned shaped at first its crown portion and then at its pavilion portion or visa versa.

1 Claim, 6 Drawing Sheets

APPARATUS AND METHOD FOR CONE SHAPING THE CROWN AND PAVILION OF GEMSTONES

BACKGROUND OF THE INVENTION

1. Field of the Invention

This invention pertains in general to the field of gemstone cutting and in particular to an apparatus and method for cone shaping the crown and pavilion portion of gemstones, especially diamonds, prior to facet polishing for use in jewelry.

2. Description of the Prior Art

Gemstones are minerals or petrified substances, such as diamonds or turquoise, that can be cut and polished for placement in jewelry. The most famous and precious gemstone is the diamond, which is a colorless mineral composed entirely of carbon crystallized in the isometric system as octahedrons, dodecahedrons, and cubes. Although this invention encompasses gemstones in general, for purposes of discussion hereinafter, reference is made primarily to the diamond as the diamond is the hardest substance and often most valued by modern society. The diamond epitomizes the cost saving inventive method of this invention, because the transition from a rough stone to brilliant cut requires time consuming, costly, highly skilled laborers. A second factor is the costly wear and maintenance of expensive faceting equipment and diamond impregnated grinding wheels. The reason why diamond cutting is an extremely laborious task and expensive process compared to other gemstones is that other than the diamond being the hardest substance, it also has grain and knots similar to wood with regard to the grain or knots, so must the diamond cutter orient the diamond before it comes in contact with the grinding wheel, and if he does encounter a twisted grain or knot ( which is almost always invisible, even to the trained eye), he can occasionally take days to grind one facet (face).

The majority of rough carbon stones used to produce brilliant cut diamonds have an irregular octahedron configuration which approximates the shape of an irregular four-sided pyramid joined at its base to another irregular four-sided pyramid. The rough stones are individually studied by the skilled laborer to determine whether one or two finished gem quality diamonds (for jewelry) are to be made from the stone. The main determination of cutting a rough stone depends upon whether the cut will result in maximum weight retention. Generally, the conversion of a rough stone diamond to a finished diamond results in the loss of approximately fifty percent of the original stone weight. Thus, two major disadvantages to the prior art is the costly need for skilled laborers to spend an excessive amount of time grinding away the unwanted bulk together with the fact that approximately 90% of the weight loss during conversion is not salvageable.

The first step in diamond cutting consists of sawing the rough stone essentially parallel to the major axis of the octahedron by a very thin phosphorous bronze disk blade having a thickness of approximately two to three one-thousandths of an inch. The edge of a blade is coated with a paste of olive oil and diamond powder.

If two diamonds are to be made from a single rough stone, each of the sawed halves are thereafter individually processed by first girdling,(brutting) or creating a cylindrical surface around the outer circumference of the stone. The girdling (brutting) is accomplished by cementing one sawed diamond half to a dop and then fixing the dop within a lathe type machine such that it rotates about an axial center line of the girdled diameter. During rotation, a technician hand machines the girdle around the stone by using an industrial diamond attached to the head of a relatively long stick. Another method to girdle (brutt) the rough diamond and other gemstones is to move a rotating dop having the rough stone centered therein into contact with a rotating grinding wheel.

Once the rough diamond has been girdled, the main reference configuration has been prepared from which all other operations comprising cutting and polishing of the stone are referenced with regard thereto. Namely, the crown (top) and pavilion (bottom) portions of the diamonds are cut and polished into a conical shape. It should be noted that the shaping/coning of the top/crown is shaped at 34° and the bottom pavilion at 41 for diamonds. These angles are the same used in the faceting process. These angles are unique to diamonds providing the completed diamond with optimum brilliance. These angles will vary from one gemstone material to another. Each facet on the finished diamond is individually cut and polished by hand. Facets are placed on the crown and pavilion by use of a large rotating cast iron wheel impregnated with diamond powder. The diamond is held in the dop attached to a tang. The dop is held in a fixed position and pressed against the wheel as it rotates. A new position is set for each facet to be grounded. The skilled technician proceeds to grind and polish each of the facets onto the surface of the stone to a predetermined depth. It should be noted that the diamond can only be ground in accordance with its crystalline structure. Further, throughout the above mentioned steps, diamond or diamond powder is required. Course Diamond powder is used for the rough cutting of the facets, and fine diamond powder for the polishing of the facets.

U.S. Pat. No. 3,202,147 issued to Roos discloses a method for making the girdle using a first axially aligned motor and dop having a diamond attached thereto angled at 90° to another axially aligned motor and dop having a second diamond attached thereto. Roos allows for bringing the rotating rough diamonds into contact with each other such that the axis of rotation of each crosses each other and whereby each of the rotating rough diamond chips the other and forms a hollow girdle on each. By moving the rotating dops backward and forward in an axial direction, girdles having purely straight profiles are obtained. When the operator sees that one stone has the correct sized girdle, it is replaced by a new rough stone and the process is continued until the other stone has assumed the correct size and shape and so on. Roos fails to disclose or teach a method to cone the crown or the pavilion portions of the stone.

Accordingly, the instant invention overcomes the above mentioned shortcoming by providing a method and apparatus which reduces the overall cutting time from rough stone to a facet-ready stone and teaches reducing the need for a skilled technician or diamond cutter by precisely shaping the crown and pavilion portions of the rough stone into a preform shape ready for placement of facets. The preformed diamond is now within ten percent of its final polished weight. Time saving is further realized with the invention through a process and a machine that permits diamond coning of at least two diamonds simultaneously without the need of grinding wheels thus permitting capture of nearly 100% of produced diamond dust.

The difficulty overcome by my invention is that in prior art the removal of unwanted bulk from gemstones was accomplished using costly highly skilled craftsman with expensive high maintenance machines whereas my invention efficiently and accurately removes the unwanted bulk and retains it using a relatively low cost machine with low cost maintenance and very low skilled workers and at least twice the speed of removal by prior art.

Precision cone making as described herein by any means is a novel unique process that has not been done before in precious gemstone cutting. The invention may also be used to shape synthetic and industrial diamonds for industrial gem purposes.

SUMMARY OF THE INVENTION

The instant invention comprises an automatic machine and method for cone shaping at least two gemstones simultaneously at their respective crown or pavilion portions. The invention can also cone shape dissimilar sized stones allowing removal of a smaller rough stone upon completion and placement of another stone in its place until the larger stone is completed. Further, the invention is not restricted to the cone shaping of two gemstones but can be set up to cone shape multiple pairs of gemstones. Furthermore the invention may be utilized to shape the crown or pavilion to facilitate step cutting by varying the angle of shaping thus forming concentric circles around the crown and pavilion. Once the gemstones are mounted (in pairs), and certain dimensional settings are made to the machine, the machine operation is automatic.

Generally the machine is comprised of a rotatable stone clamp for positioning a stone by its girdle to a first base movable about the axis of the rotatable stone clamp. The first base is mounted to a second base having a means for oscillating said second base in a predetermined angular motion along the longitudinal axis of the rotatable stone clamp. A second rotatable stone clamp is mounted to a third base which is movable at substantially 45° to the longitudinal axis of the second rotating stone clamp, but such that the resulting motion is perpendicular to the back and forth motion of the first rotating stone clamp arrangement. The second rotating clamp is attached to the third base such that the longitudinal axis of the second clamp is at substantially a 90° angle to the longitudinal axis of the first stone clamp.

For operation, the pavilion ends of the girdled stones are each mounted in their respective stone clamps and the bases arranged approximately perpendicular to each other, the rough stone disposed within the second stone clamp is juxtapositioned to the first rough stone disposed with the first stone clamp, each clamp rotating in opposite directions. In addition, the first stone clamp is oscillated between its juxtaposition and a second position in and out of physical contact between the stones to prevent shock, heat, and allow for microscopic chip removal. The second rotating stone clamp is intermittently fed inward at a predetermined speed by means of a variable speed regulator until the crowns of each of the rough stones are machined into a truncated, conical shape. The stones are turned end-for-end in each of their respective stone clamping devices exposing the pavilion portion. In a similar manner to the above, the pavilion portion of each stone is machined into a truncated, conical shape. The completion of each stone occurs substantially simultaneously with each other. With the coning complete, the stones are available for grinding the facets in accordance with the prior art procedure with the exception that the surface angle is precisely defined allowing minimum facet grinding by skilled craftsman.

Accordingly, a primary object of the present invention is to provide a method and apparatus for coning the crown and pavilion portions of a rough gemstone into a conical shape at any given angle or several given angles.

Another object of the present invention is to provide apparatus and methods for cone shaping of rough diamonds whereby multiple sets of two diamonds are simultaneously shaped such that each diamond acts as the cutting edge for the other diamond.

Yet still another objective of the instant invention is to provide a preliminary step before facet grinding allowing a predetermined angular cone shaped surface which greatly reduces the experts time required for facet grinding by approximately fifty percent.

Still another object of the instant invention is the reduction of wear and associated replacement cost of facet grinding wheels by removing the angular irregularity down to the proposed angular dimensional surface.

Yet still another object of the instant invention is ability to capture diamond dust through the coning stage providing a previously untapped source of diamond dust for subsequent use on grinding wheels, industrial use and so forth.

The above-stated objects as well as other objects which, although not specifically stated, but are intended to be included within the scope of the present invention, are accomplished by the present invention and will become apparent from the hereinafter set forth Detailed Description of the Invention, Drawings, and the Claims appended herewith.

BRIEF DESCRIPTION OF THE DRAWINGS

Various other objects, advantages, and features of the invention will become apparent to those skilled in the art from the following discussion in conjunction with the following drawings, in which.

DESCRIPTION OF THE PREFERRED EMBODIMENTS

Figure 1:
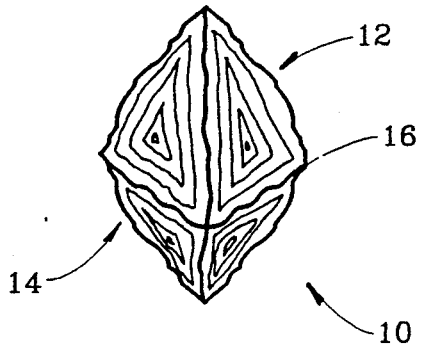
FIG. 1 is a typical rough diamond in perspective having an octahedron configuration with growth (grain) markings on its surface.
Figure 2:
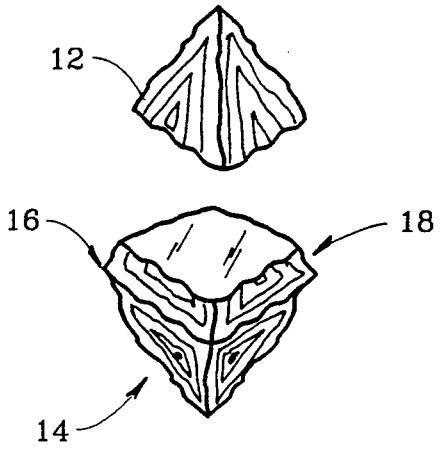
FIG. 2 is a perspective view of the rough diamond of FIG. 1 sawed into two pieces.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. For discussion purposes, reference hereinafter is made to the shaping of a diamond, although any gemstone is deemed to fall within the scope of this invention.

Reference is now made in general to FIGS. 1-5 which illustrates a typical octahedronically-shaped rough diamond 10 of sufficient size as to be further processed into one or two finished diamonds. Typically, the rough diamond 10 is of an irregular octahedron shape. That is, each rough diamond can be viewed as two attached four-sided pyramids having faces and angles of different sizes. The top portion 12 may be off center and of a different degree and size and shape than the bottom portion 14. The rough diamond is determined to have a centerline 16 about the circumference distinctly defining the upper 12 and lower 14 portions. After determining that the rough cut diamond 10 is to be cut into two diamonds, typically the lower portion 14 is significantly larger than the upper portion 12, the rough diamond 10 is cut slightly above its main center line 16 so as to provide a crown portion 18 on the diamond 14. Thereafter, the lower diamond 14 will be used in the process described hereinafter. The upper diamond 12 can be matched with another proportionate size and processed in a similar fashion as the bottoms. Alternatively, the diamond 10 can be sawed directly across its centerline 16 such that approximately two equal sized upper and lower diamonds would result therefrom. Such an alternative would delete the crown portion initially presented with the lower sawed half, but does not have to be provided for, even though the two halves are to be further processed into finished diamonds having a round, brilliant cut.

Figure 3:
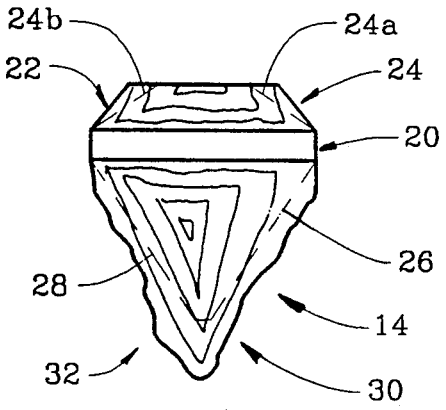
FIG. 3 is a side elevational view of the lower portion of the diamond of FIG. 2 with a girdle shaped about its circumference.
Figure 4:
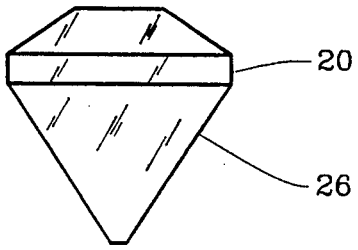
FIG. 4 is a front elevational view of the lower portion of the diamond of FIG. 3 with a predetermined conical shape illustrated.
Figure 5:
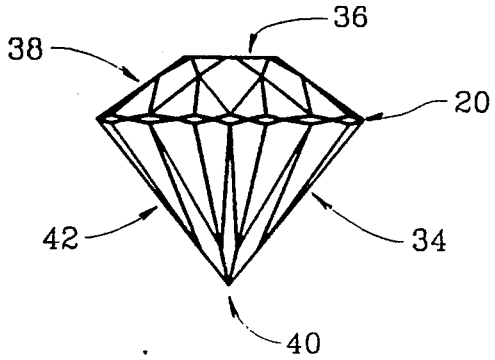
FIG. 5 is a front elevational view of a completed diamond with facets illustrating the crown and pavilion portions of the stone.

The rough diamond portion 14 is next processed to provide a girdle 20 around the major base. As shown in FIG. 3, the lower diamond 14 is still irregularly shaped such that it is skewed to the right. It may be seen that the crown portion 24 is to be machined such that a right regular cone along the lines shown for surfaces **24*a* and 24*b* will result therefrom. Similarly, the pavilion of diamond 14 is to be machined along the right circular cone lines shown as surfaces 26 and 28. In this regard, surfaces 22, 30 and 32 must be removed allowing for truncated right cone and appropriate and standard facets 34 may be cut and polished onto diamond 14 so as to present a finished diamond (FIG. 5). The portion between the table 36 and the girdle 20 defined as the crown 38. The portion between the culet 40 and the girdle 20 defined as the pavilion 42**.

Figure 6:
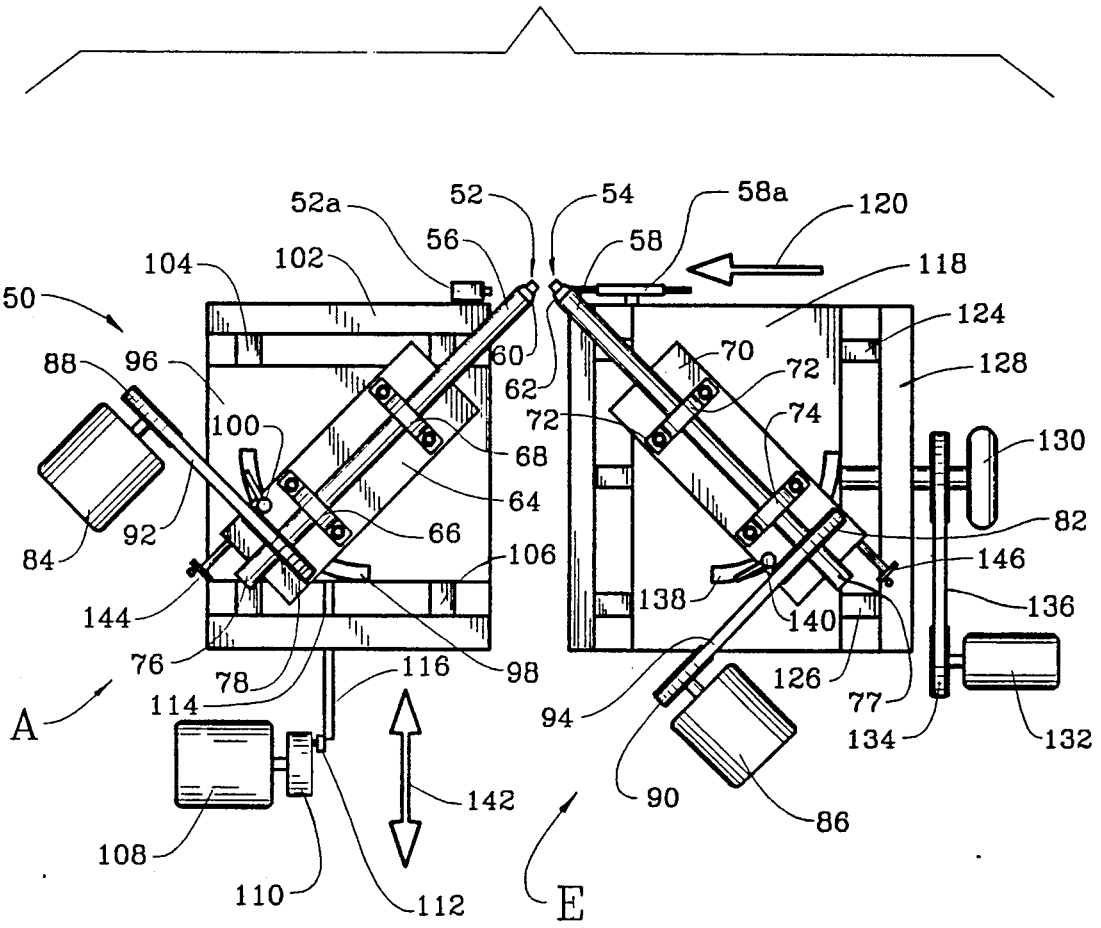
FIG. 6 is an top plane view of a two stone coning apparatus of the instant invention.

Now referring to FIG. 6 the machine for coning two diamonds simultaneously is depicted in a top plan view generally by numeral 50 wherein two rough, girdled diamonds 52 and 54 similar in size and shape as that shown in FIG. 3 are each mounted into respective clamping devices 56 and 58 by collets 60 and 62 encompassing the girdle in positioning the pavilion portion of each of said diamonds into the female portion of the respective clamping devices. Clamping device 56 is secured to clamping base 64 by bearing mounts 66 and 68. Clamping device 58 is secured to clamping base 70 by bearing mounts 72 and 74. Each of the diamonds 52 and 54 are mounted with respect to clamping devices 56 and 58 such that the previously prepared girdles are concentric with the axial center line of the respective bearing housings. In this manner, each of the diamonds 52 and 54 will rotate about the axial center line of their girdle portions. This results in the proper location of the conical surfaces of the crown for grinding. Near the end 76 of clamping device 56 is placed a grooved pulley 78 mounted concentric to the axial center line of the respective bearing housings 66 and 68. Similarly, near the end 77 of clamping device 58 is placed grooved pulley 82 mounted concentric to the axial center line of the respective bearing housings 72 and 74.

Synchronous motors 84 and 86, grooved pulleys 88 and 90, and drive belts 92 and 94 are respectively attached to pulleys 78 and 82 so as to rotate clamping device 56 and 58 and accordingly, diamonds 52 and 54. Each of the motors 84 and 86 comprise approximately one-half horsepower motors having a rotational speed of approximately 1750 rpm. The pulley pairs 88 and 90, and 78 and 82, are arranged such that clamping devices 56 and 58 rotate in opposite directions in a 1:1 ratio. The rotational speed of each shaft is not deemed a limited factor of this invention and various rotational speed can be employed with equal success.

Motor 84 may be mounted as a unit to the base 64 which is pivotally mounted for angular rotation thereon to support block 96. Accordingly, clamping device 56 may be angularly rotated about a point along the axial center line of the same and with regard to the radius provided in track 98 with a manual locking clamp 100 rigidly positioning the bearing base 64 in accord with support block 96. Thus, the axial center line of clamping device 56 may be adjusted with regard to the approximately 90° angle provided between it and the axial center line of clamping device 58. Block 96 is mounted to base 102 such that it may move at an angle of approximately 45° back and forth to the axial center line of clamping device 56. Guide tracks 104 and 106 are operatively associated with block 96 for parallel tracking of block 96.

Motor 108 is utilized to provide an oscillating movement of block 96 back and forth on tracks 104 and 106 by means of oscillator disk 110 having offset 112 coupled to the block 96 at coupling 114 employing coupling bar 116. Rotation of motor 108 provides for rotation of disk 110 and back and forward motion of member 116 and, accordingly, base 64. The back and forward motion of diamond 52 may be approximately 60 cycles per minute, however, the actual number of cycles depends on size of diamond being coned. The 60 cycles per minute may be varied using a variable speed controller. The length of stroke may be varied by off center adjustment on oscillator disc 110. Further adjustment to permit the diamond 52 to oscillate within the parameters determined to contact diamond 54 is done by adjusting length of coupling bar 116.

Conversely clamping device 58, base 70 and motor assembly 86 may be fixtured to support plate 118. Plate 118 and hence, diamond 54, may move at an approximate 45° angle with regard to the axial center line of clamping device 58 in the direction indicated by arrow 120. Tracks 124 and 126 support 128 provide for precise movement of diamond 54. Clamping device 58 may be angularly rotated about a point along the axial center line of the same and with regard to the radius provided in track 138 with a manual locking clamp 140 rigidly positioning the bearing base 70 in accord with support base 118. Vernier apparatus 130 provides for manual motion of diamond 54 toward diamond 52. Vernier apparatus 130 is automatically driven by motor 132 utilizing pulley 134 and belt 136 to effectuate the motion of diamond 54 in the direction of arrow 120. (Of course, Vernier apparatus may be worm driven by shaft connecting motor 132). In accordance with my apparatus diamonds 52 and 54 are crown coned to an exact predetermined angular surface. In operation, after the angle between clamping device 56 and 58 has been adjusted in accordance with the radiuses track 98 and 138, diamond 52 is rotated with clamping device 56 while being moved back and forth in accordance with arrow 142. Diamond 54 is rotated within clamping device 58 and is moved toward diamond 52 in accordance with arrow 120. These motions are continued, causing microscopically chipping as each stone wears into each other until such time as the crown portions of diamonds 52 and 54 have been properly and simultaneously coned. Micrometer adjustments means 144 and 146 is useful for correction of diamond projection that is not taken up by movement of bases 64, 70 along angular tracks 98, 138 or by means of clamping chamber adjustment described below. The micrometer adjustments finding particular usefulness in multiple diamond shaping lines also described in detail later in this specification. Once each of the diamonds has been cone shaped at its crown portion, the diamonds are respectively rotated end for end within their respective clamping devices and such that the girdle previously machined onto the diamonds is utilized as the reference surface in order to thereafter cone cut the pavilion portion of the diamonds. The angles of 45° and 90° given are examples only. The actual angles are determined by the gemstone surface angles desired.

Figure 7:
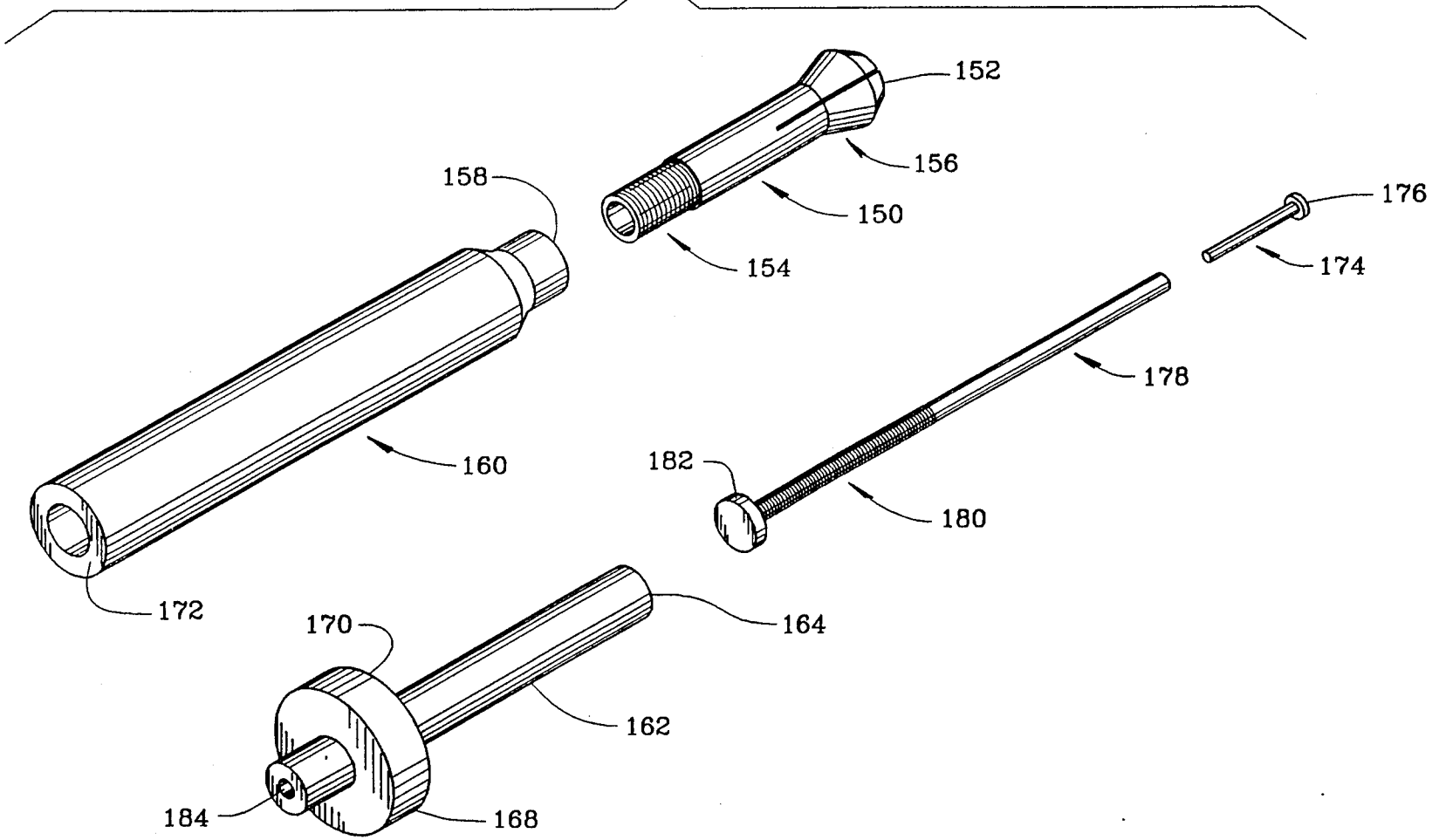
FIG. 7 is an exploded perspective view of the clamping device for holding of a stone operatively associated with the instant invention.

FIG. 7 displays the clamping device of the instant invention comprising a collet 150 having claws 152 at one end and the opposite end having threads 154 for drawing. The collet 150 exchangeable for different sized stone by use of various diameter spanning claws 152 with chamfer 156 operatively associated with opening 158 of axle housing 160 whereby draw of end 154 into the axle housing 160 causes chamfer 156 to engage opening 158 tightly clamping claws 152. Claw draw 162 engages threads 154 of collet 150 by fitting within axle housing with enlarged wheel 168 preventing full insertion into end 172 and surface 170 engages end wall 172 for drawing down the stone holder. Stone extension is made possible by interchangeable pin 174 having plug 176 insertable into pin shaft 178. Pin shaft 178 having threaded portion 180 and adjustment handle 182 for disposition within opening 184, wherein adjustment handle 182 allows the threads 180 to engage the claw drawer for precise extension to various stone depths. Pin 174 is interchangeable for various size stones.

Figure 8:
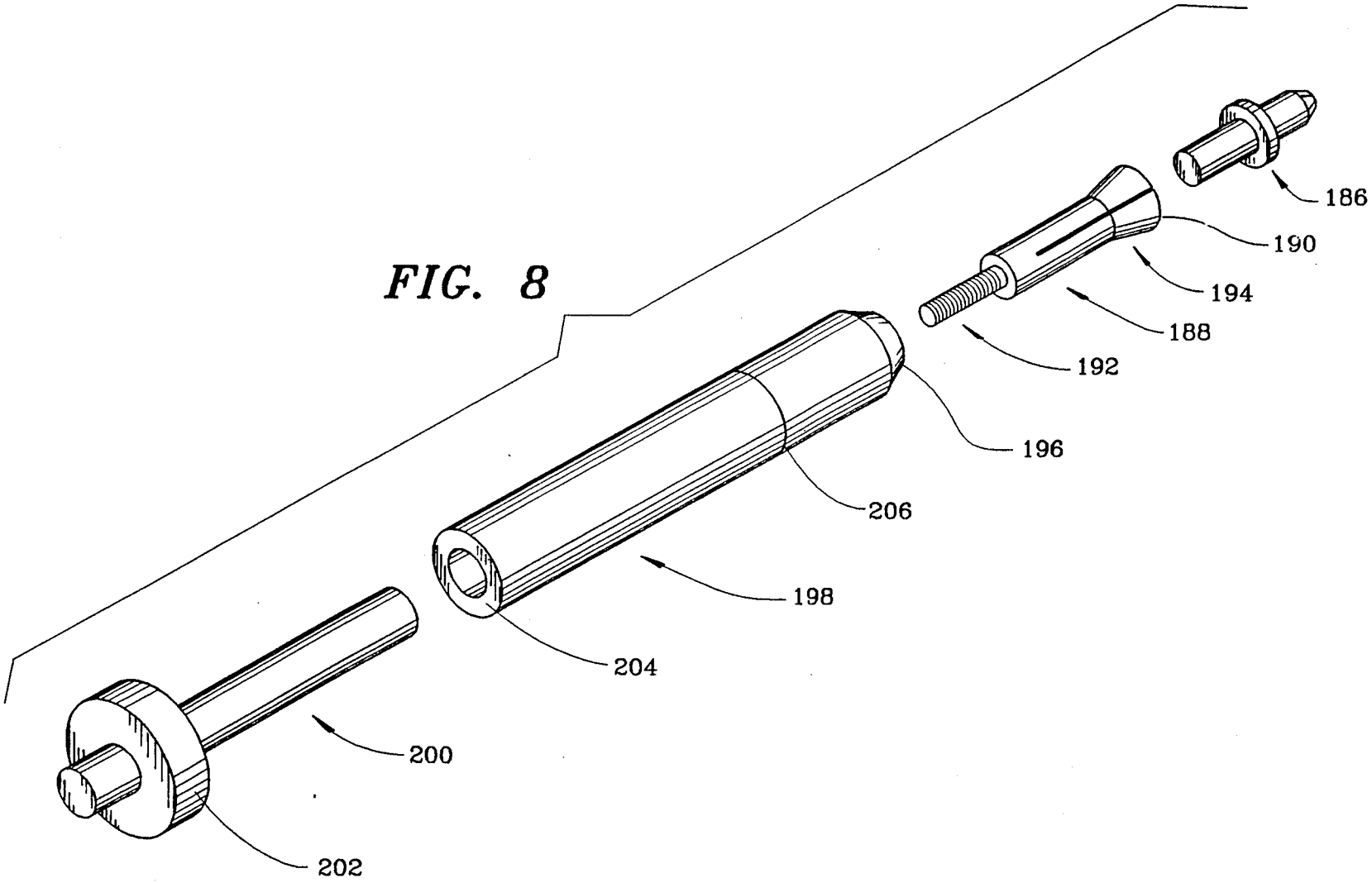
FIG. 8 is an exploded perspective view of the dop used in the prior art for holding a stone for facet grinding and with a modified dop holder allowing dop use on the instant device.

FIG. 8 displays an alternative embodiment of the clamping device for use with a conventional dop by means of collet 188 having claws 190 at one end and the opposite end having threads 192 for drawing. The collet 188 is exchangeable for different sized dops by use of various diameter claws 190 wherein chamfer 194 is operatively associated with opening 196 of axle housing 198 whereby the draw of end 192 into the axle housing 198 causes chamfer 194 to engage opening 196 tightly clamping claws 190. Claw draw 200 engages threads 192 of collet 188 with enlarged wheel 202 engaging end wall 204 for drawing down the collet 188. The axle 198 may also be configured out of two pieces, coupled together at line 206 allowing for changeable ends that will permit the accommodation of any type of dop and dop holder currently used in the gemstone cutting/polishing process.

Figure 9:
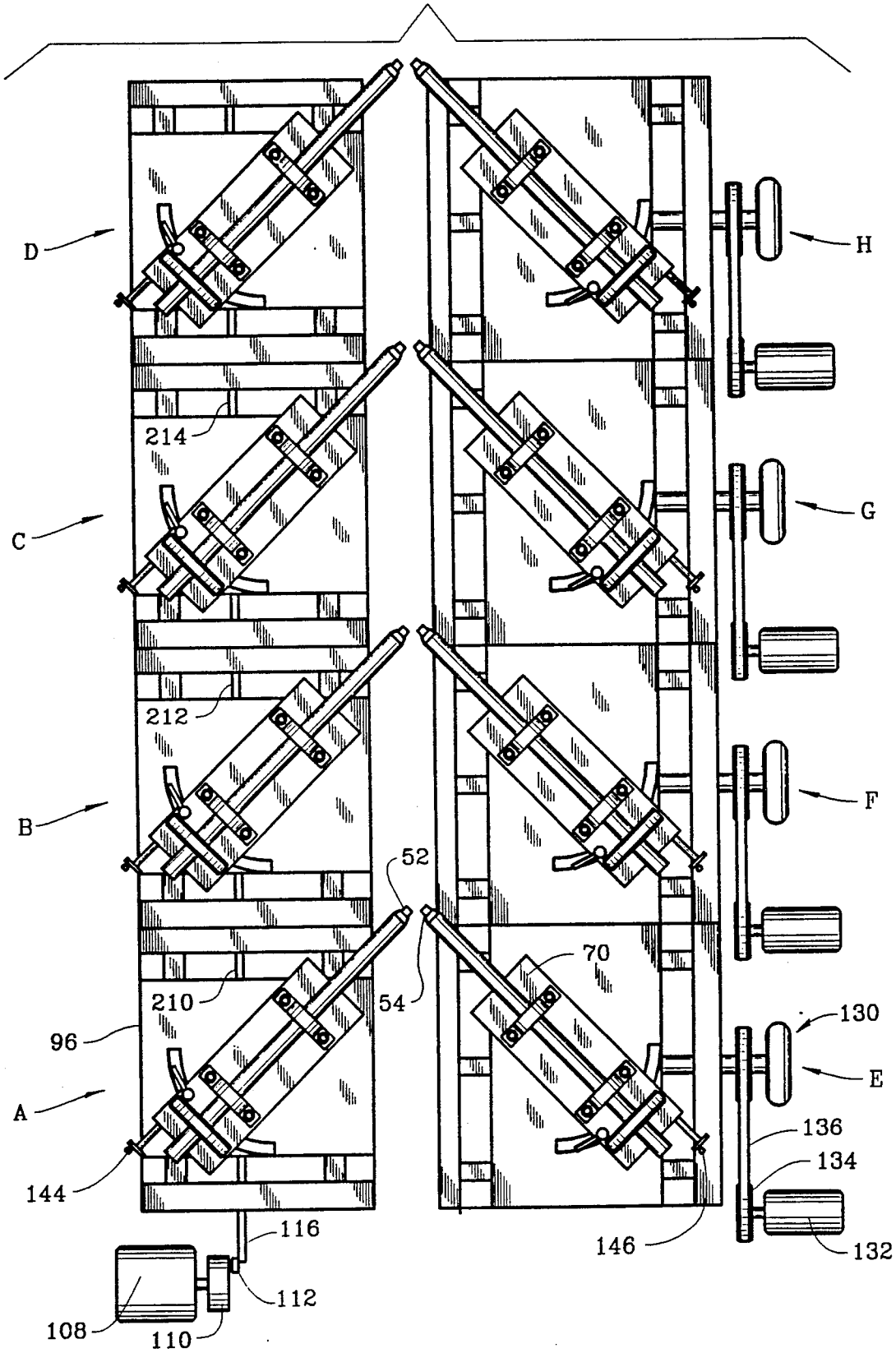
FIG. 9 is a top plane view of a eight stone coning apparatus of the instant invention.

Now referring to FIG. 9 the apparatus for coning eight diamonds simultaneously is depicted generally by units A and E detailed in FIG. 6 and incorporated within FIG. 9 as if fully repeated. In this embodiment the oscillation of base frame 96 is transferred to Unit B by coupling point 210 and then to Unit C by coupling point 212 and finally to Unit D by coupling point 214. Similarly, Units E, F, G, and H are depicted having individually bases 70 operatable by vernier apparatus 130 providing manual motion of diamond 54 toward diamond 52. Each base coupling to support base 118 as previously described wherein vernier apparatus 130 is automatically driven by motor 132 and V pulley 134 by belt drive 136 to effectuate the motion of diamond 54 in the direction of arrow 120. In accordance this the multiple configuration, Units A,B,C, & D are oscillating while Units E,F,G, & H are moved toward the oscillating Units. These motions are continued causing microscopic chipping as each stone wears into each other until such time as the gemstone is properly and simultaneously coned. Mention should be made that Units E, F, G and H may be mounted on a single base and permit the four units to be incrementally fed in unison with the use of a single vernier apparatus and drive. Micrometer adjustment means 144 and 146 are particularly useful for on the multiple units for correction of diamond projection with regard to movement of the bases. The micrometer 58*a* adjustments are made to adjust the depth of cut when automatic shutoff pressure switch 52*a* contacts the end of micrometer 58*a* electrically shutting off the machine at the desired diamond surface depth removal. The use of a stroboscope facilitates the verification of chip removal during stone rotation.

Figure 10:
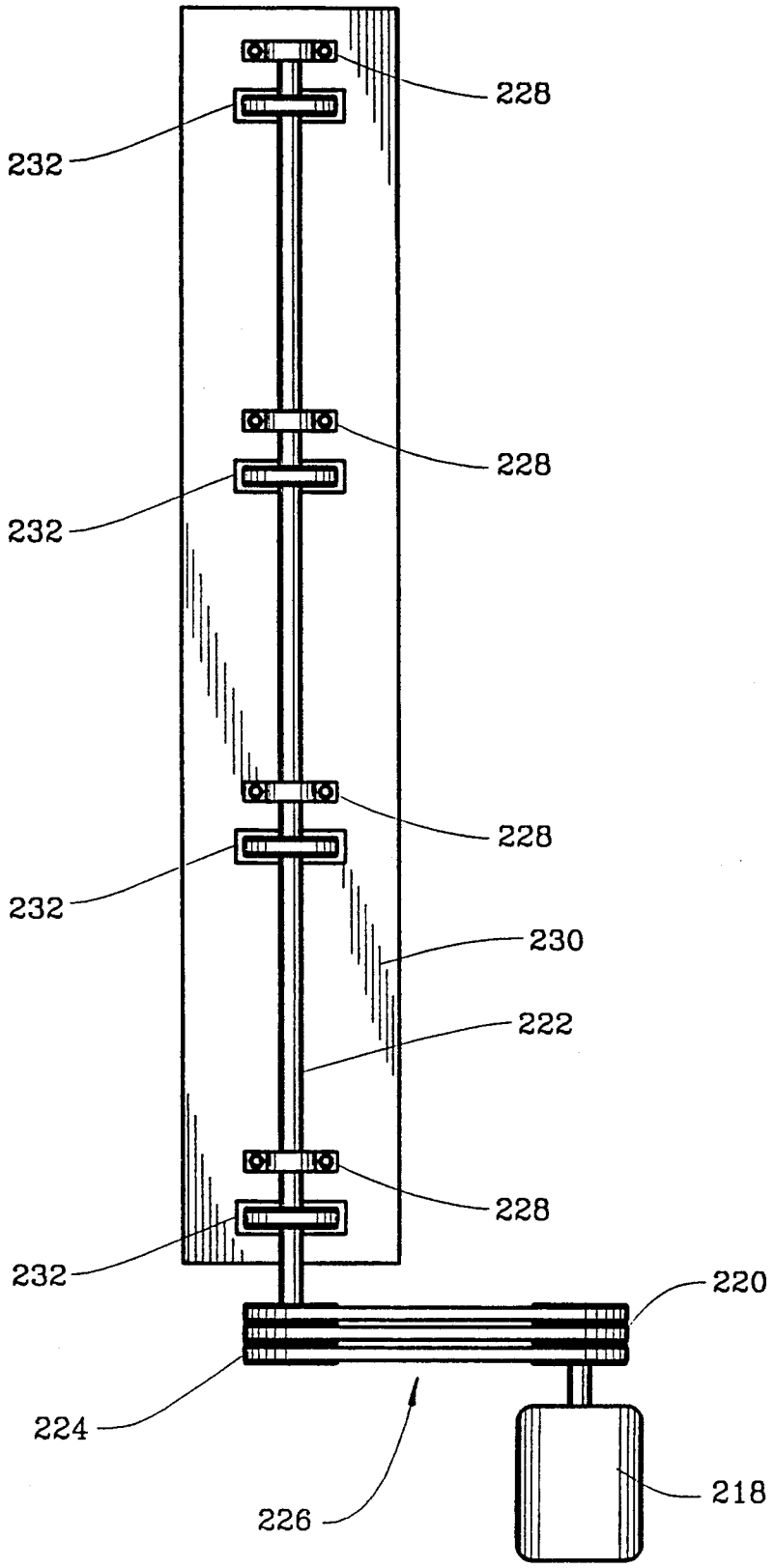
FIG. 10 is a top plane view of the drive system for the eight stone coning apparatus shown in FIG. 9.

FIG. 10 illustrates a drive means for a plurality of units replacing the individual drive means depicted by motors 84 and 86 of FIG. 6. Motor 218 rotates pulleys 220 which in turn rotates drive shaft by means of pulleys 224 driven by belts 226. Bearing housings 228 maintain the drive shaft 222 against support 230 allowing belt drives 232 to operating the pulleys 78 and 82 on each Unit. The use of flexible belt permits accurate rotation of each individual clamping device without interfering with the operation of the remaining Units. The drive means in FIG. 10 may be mounted directly above pulleys 78 and 82 as shown in FIG. 6.

The rod 116 in FIG. 6 is adjustable in length by use of a two piece rod with a set screw to adjust the oscillation period. While the invention has been described, disclosed, illustrated, and shown in certain terms or certain embodiments or modifications which it has assumed in practice, the scope of the invention is not intended to be nor should it be deemed to be limited thereby and such other modifications or embodiments as may be suggested by the teachings herein are particularly reserved especially as they fall within the scope of the breadth and scope of the claims here appended.

What I claim is:

1. An apparatus for shaping first and second diamonds, each having a girdle, comprising:

a first pair of fixed elongated guide tracks disposed in parallel relation to one another in a horizontal plane;

a plane base plate operatively associated with said first guide tracks having two side edges and two ends, the ends of said first base plate slidable between a first and a second position along said first guide tracks;

means for oscillating said first base plate between said first pair of guide tracks;

at least one first elongated rotatable clamping device coupled to said first base plate, said first clamping device arcuately rotatable along a first arcuate guide track;

first means for locking said first clamping device about a first arcuate guide track for locking said first clamping device in a predetermined position;

at least one means for grasping the girdle of a first rough diamond operatively associated with said first clamping device;

a second pair of fixed elongated guide tracks disposed in parallel relation to one another in a horizontal plane perpendicular to said first pair of tracks;

a second base plate operatively associated with said second guide tracks having two side edges and two ends, the ends of said second base plate slidable between a first and a second position along said second guide tracks;

means for micro-adjustment of said second base plate between the first and second position of said second guide tracks;

at least one second elongated rotatable clamping device coupled to said second base plate, said second clamping device arcuately rotatable along a second arcuate guide track;

second means for locking said second clamping device about said second arcuate guide track for locking said second clamping device in a predetermined position; and at least one second means for grasping the girdle of a second rough diamond operatively associated with said second clamping device; whereby said first and second diamonds are rotatably contacted together for purposes of simultaneous cone formation.

* * * * *